US010072912B2

(12) United States Patent
Marlin et al.

(10) Patent No.: US 10,072,912 B2
(45) Date of Patent: Sep. 11, 2018

(54) PYROTECHNICAL GAS GENERATOR

(71) Applicant: ARIANEGROUP SAS, Paris (FR)

(72) Inventors: Frederic Marlin, Saint Medard en Jalles (FR); Romain Lorenzon, Eysines (FR); Raphael Teoldi, Leognan (FR)

(73) Assignee: ARIANEGROUP SAS, Paris (FR)

( * ) Notice: Subject to any disclaimer, the term of this patent is extended or adjusted under 35 U.S.C. 154(b) by 0 days.

(21) Appl. No.: 14/891,772

(22) PCT Filed: May 16, 2014

(86) PCT No.: PCT/FR2014/051147

§ 371 (c)(1),
(2) Date: Nov. 17, 2015

(87) PCT Pub. No.: WO2014/184505

PCT Pub. Date: Nov. 20, 2014

(65) Prior Publication Data

US 2016/0131459 A1 May 12, 2016

(30) Foreign Application Priority Data

May 17, 2013 (FR) ..... 13 54455
Jun. 28, 2013 (FR) ..... 13 56293

(51) Int. Cl.
*F42B 3/04* (2006.01)
*F15B 15/19* (2006.01)
*F42B 3/00* (2006.01)

(52) U.S. Cl.
CPC ..... *F42B 3/04* (2013.01); *F15B 15/19* (2013.01); *F42B 3/006* (2013.01)

(58) Field of Classification Search
CPC ... F42B 3/04; F42B 3/006; C06C 5/04; F02K 9/26; B60R 21/264; B60R 21/2644;
(Continued)

(56) References Cited

U.S. PATENT DOCUMENTS 2,446,560 A * 8/1948 Skinner ..... F02K 9/36 102/285
2,813,487 A * 11/1957 Miller ..... F02K 9/26 102/290
2,892,452 A 6/1959 Weinstock
(Continued)

FOREIGN PATENT DOCUMENTS

EP 0 550 321 7/1993
FR 2 959 006 10/2011
(Continued)

OTHER PUBLICATIONS

International Search Report dated Apr. 14, 2015 in PCT/FR14/051147 Filed May 16, 2014.

*Primary Examiner* — Stephen Johnson
*Assistant Examiner* — Joshua T Semick
(74) *Attorney, Agent, or Firm* — Oblon, McClelland, Maier & Neustadt, L.L.P.

(57) ABSTRACT

A pyrotechnic gas generator for driving an actuator includes a body defining a combustion chamber housing a main pyrotechnic charge, and an ignitor for initiating combustion of the main pyrotechnic charge. The pyrotechnic gas generator includes at least one delay chamber adapted to communicate with the combustion chamber via at least one inlet orifice, and the delay chamber is provided with at least one outlet orifice for passing gas out from the gas generator. The at least one outlet orifice is provided with a seal adapted to pass from a closed state to an open state when the pressure inside the delay chamber reaches a rupture limit pressure.

19 Claims, 2 Drawing Sheets

(58) Field of Classification Search
CPC ..... B60R 21/2646; B60R 2021/2642; B60R 2021/2648; C06D 5/00; F15B 15/19
See application file for complete search history.

(56) References Cited

U.S. PATENT DOCUMENTS

| | | | | | |
|---|---|---|---|---|---|
| 3,017,744 | A | | 1/1962 | Jett | |
| 3,108,433 | A | * | 10/1963 | De Fries | F02K 9/10 102/290 |
| 3,352,244 | A | * | 11/1967 | Holter | F02K 9/10 102/289 |
| 3,558,285 | A | * | 1/1971 | Ciccone | C10J 3/00 102/531 |
| 3,773,351 | A | * | 11/1973 | Catanzarite | B60R 21/017 102/531 |
| 4,220,087 | A | * | 9/1980 | Posson | C06C 5/04 102/275.6 |
| 4,328,736 | A | * | 5/1982 | True | F42B 3/04 102/531 |
| 5,303,631 | A | * | 4/1994 | Frehaut | F15B 15/19 60/637 |
| 5,682,013 | A | * | 10/1997 | Smith | C06B 45/12 102/290 |
| 6,176,517 | B1 | * | 1/2001 | Hamilton | B60R 21/2346 102/289 |
| 7,652,868 | B2 | * | 1/2010 | Gaudinat | F42B 3/182 361/264 |
| 8,752,569 | B2 | * | 6/2014 | Alfert | F16K 31/003 137/68.13 |
| 8,960,718 | B2 | * | 2/2015 | Patton | B60R 21/2644 280/737 |
| 8,967,046 | B2 | * | 3/2015 | Dunaway | F41F 3/04 102/202 |
| 9,212,103 | B2 | * | 12/2015 | Coppedge | C06D 5/00 |
| 2005/0218637 | A1 | | 10/2005 | Burns | |
| 2006/0005734 | A1 | * | 1/2006 | McCormick | B60R 21/2644 102/530 |
| 2013/0036934 | A1 | | 2/2013 | Prima et al. | |

FOREIGN PATENT DOCUMENTS

| | | |
|---|---|---|
| GB | 2 432 399 | 5/2007 |
| WO | 2004 024653 | 3/2004 |

* cited by examiner

PYROTECHNICAL GAS GENERATOR

BACKGROUND

The invention relates to a pyrotechnic gas generator.

More particularly, the invention relates to a pyrotechnic gas generator for driving an actuator, in particular an actuator for closing and/or opening a structure such as a door, a partition, or a valve in a building, a ship, or an airplane.

The gas generator of the invention is particularly suitable for being incorporated in a manually-triggered actuator.

Pyrotechnic gas generators used for driving actuators are well known. By way of example, Document FR 2 880 659 describes a gas generator for driving an actuator for opening an airplane door in an emergency. In certain circumstances, it can happen that the control for triggering the gas generator is situated in the immediate proximity of the door that is to be actuated. In this context, triggering the generator may present a danger for the operator, if the operator does not have sufficient time to move away from the door before it starts moving suddenly.

BRIEF SUMMARY

An object of the present invention is to provide a gas generator for driving an actuator that is safer in use.

This object is achieved by a pyrotechnic gas generator for driving an actuator, the generator comprising a body defining a combustion chamber housing a main pyrotechnic charge, and an ignitor for initiating combustion of said main pyrotechnic charge, said pyrotechnic gas generator being characterized in that it includes at least one delay chamber housing no pyrotechnic charge that is defined by walls that are stationary relative to one another and that is adapted to communicate with said combustion chamber via at least one inlet orifice, and in that said delay chamber is provided with at least one outlet orifice for passing gas out from said gas generator, said at least one outlet orifice being provided with a seal adapted to pass from a closed state to an open state when the pressure inside the delay chamber reaches a rupture limit pressure.

With the gas generator of the invention, the gas generated by the combustion of the main pyrotechnic charge inside the combustion chamber is not discharged from the gas generator on leaving the combustion chamber, but instead it transits via a delay chamber of the gas generator.

In the initial state of the gas generator, an outlet orifice from the delay chamber for allowing the gas to exit to the outside of the gas generator is shut.

Thus, the pressure inside the delay chamber increases as gas continues to penetrate into the delay chamber.

Only once the pressure inside the delay chamber has reached the rupture limit pressure at which the seal is ruptured or moved out of the way, is/are the outlet orifice(s) from said chamber opened, such that the gas can then escape from the delay chamber and from the gas generator.

In the present description, the term "delay" chamber is used to mean a chamber that, unlike the combustion chamber, does not house any pyrotechnic charge.

The time required for the pressure to rise in the delay chamber from ignition of the main pyrotechnic charge to rupture of the seals shutting each of the outlet orifices from the delay chamber provides a delay function between triggering of the ignitor and gas being delivered out from the gas generator. When the gas generator is for driving an actuator, the length of time between the ignitor being triggered and the actuator actually being driven (movement of the sliding assembly including in particular the piston) is increased. Thus, if the actuator is for driving the movement of a structure, people situated in the proximity of the structure have enough time to move away from it after triggering the ignitor.

In addition, the delay chamber has a damping effect (in terms both of frequency and of impulse) on the operation of the actuator with which the gas generator is associated.

In an embodiment, the body of the gas generator is elongate in a main direction, the combustion chamber and the delay chamber being arranged one after another inside said body along the main direction.

In an example, the combustion chamber is situated downstream from the ignitor, and the delay chamber is situated downstream from the combustion chamber.

In an example, the delay chamber is defined in the main direction by an upstream wall and by a downstream wall, and the inlet orifice is arranged in said upstream wall and the outlet orifice is arranged in said downstream wall.

In the present description, unless specified to the contrary, an axial direction is a direction parallel to the main axis of the body of the gas generator. Also, a radial direction is a direction perpendicular to the main axis of the body and intersecting that axis.

Unless specified to the contrary, the adjectives and adverbs "axial", "radial", "axially", and "radially" are used with reference to the above-specified axial and radial directions. Similarly, an axial plane is a plane parallel to the axis of the main body of the generator, and a radial plane is a plane perpendicular to said axis.

Finally, the terms "upstream" and "downstream" are defined relative to the travel direction of gas inside the gas generator. When the gas generator is coupled to an actuator, the terms "upstream" and "downstream" generally correspond to the direction in which the piston slides under the effect of the gas generator being triggered.

In an embodiment, the combustion chamber and the delay chamber present a common intermediate wall extending substantially transversely across said main direction and having formed therein said at least one inlet orifice of the delay chamber.

In an embodiment, the outlet orifice from the delay chamber is provided in the wall of said chamber that is distant from the combustion chamber along the main direction.

According to an advantageous provision, the body of the gas generator is cylindrical.

In an embodiment, the main pyrotechnic charge is arranged inside the combustion chamber in such a manner as to define a gas-passing passage radially between the wall of the combustion chamber and the charge. Under such circumstances, the pyrotechnic charge may be in the form of a solid block or of a stack of solid disks. The space as defined in this way then extends along the entire length of the pyrotechnic charge along the main direction of the gas generator in such a manner that the gas can transit to the outlet orifice of the combustion chamber.

For example, the pyrotechnic charge is spaced apart from the wall of the combustion chamber by spacer means, in particular by centering rods.

In another example, the pyrotechnic charge includes locally at its periphery at least one projecting portion adapted to bear against the wall of the combustion chamber. The pyrotechnic charge is thus spaced apart from the wall of the combustion chamber beside the projecting portion and a passage for gas is defined on either side of said projecting portion.

According to a provision of the invention, the inlet orifice of the delay chamber is provided with a seal suitable for passing from a closed state to an open state when the gas pressure inside the combustion chamber reaches a rupture limit pressure. A first effect of this provision is to ensure that pressure rises quickly in the combustion chamber on ignition of the main pyrotechnic charge. Ignition is reliable and reproducible, without any risk of extinction. A second consequence is that the delay with which the gas generated by the pyrotechnic charge escapes from the gas generator is emphasized.

In an advantageous embodiment, the ignitor comprises a pyrotechnic initiator.

In order to operate the pyrotechnic initiator, the ignitor may comprise mechanical trigger means (e.g. a piezoelectric relay or a cap striker) or electrical means for triggering the pyrotechnic initiator (an electro-pyrotechnic initiator), in particular connected to a control unit.

In an embodiment, the pyrotechnic initiator is arranged to be capable of acting directly to ignite the main pyrotechnic charge contained in the combustion chamber.

In a variant, the initiator is spaced apart from the main pyrotechnic charge and in addition to the pyrotechnic initiator, the ignitor further comprises an ignition relay.

In the present description, the term "ignition relay" is used to mean an intermediate pyrotechnic charge adapted to receive a signal for priming the pyrotechnic initiator and to transmit this signal to the main pyrotechnic charge.

In an embodiment, the gas generator includes an ignition chamber adapted to communicate with said combustion chamber via at least one ignition orifice, and the pyrotechnic initiator and the ignition relay are housed in this ignition chamber. Under the effect of a trigger command, the pyrotechnic initiator initiates combustion of the ignition relay, which generates gas inside the ignition chamber. On penetrating into the combustion chamber via the ignition orifice, this gas initiates combustion of the main pyrotechnic charge.

The ignition orifice is optionally sealed so as to enable pressure to rise rapidly in the ignition chamber and enable the ignition relay to be ignited reliably. The duration of combustion of said ignition relay typically lies in the range 0.1 seconds to 1 s.

In characteristic manner, the combustion chamber presents an empty a free volume that is small (typically in the range 1 cubic centimeter (cm3) to 20 cm3) so as to enable pressure to rise quickly and combustion of the main pyrotechnic charge to be stable.

In the present description, the term "empty" volume of a chamber is used to mean the initial volume of that chamber that can be occupied by gas (i.e. the volume prior to triggering the gas generator).

Preferably, the free volume of the delay chamber is greater than four times, preferably greater than 20 times, the free volume of the combustion chamber. The pressure rise inside the delay chamber is thus generally slower than the pressure rise in the combustion chamber.

In general manner, the person skilled in the art knows how to determine the optimum volume for the delay chamber as a function of the respective flow sections of the inlet orifice and of the outlet orifice of the delay chamber, in order to ensure that there is sufficient pressure in the combustion chamber. In particular, if the inlet orifice of the delay chamber is of sufficiently small size to form a nozzle, then the volume of the delay chamber can be large. Otherwise, if the inlet orifice of the delay chamber is of large section, then the volume of the delay chamber is preferably limited, as is the section of its outlet orifice, in order to avoid extinguishing combustion of the main pyrotechnic charge.

The main pyrotechnic charge may present a wide variety of configurations, in particular in terms of shapes and dimensions. For example, it may be in the form of grains, pellet(s), or indeed solid disk(s) or block(s), having one or more channels and/or lobes. The shapes of these elements may for example be spherical, egg-shaped, or cylindrical. Grains generally weigh a few milligrams, pellets generally weigh a few tenths of a gram to few grams, and disks and blocks generally weigh a few tens of grams up to about a hundred grams.

By way of example, the main pyrotechnic charge may present a composition of the type described in patent applications WO 2006/134311 and WO 2007/042735, in particular a composition constituted for the most part by guanidine nitrate and basic copper nitrate.

The person skilled in the art can easily adjust the speed of combustion of these compounds and can dimension the main pyrotechnic charge so as to obtain appropriate pressurization sequences.

In an embodiment of the invention, a portion of the combustion surface area of the main pyrotechnic charge may be covered in a combustion-inhibiting protective coating.

Generally, the portion that is combustion-inhibited is covered in a layer of combustion-inhibiting material in the form of a (non-combustible) varnish. This method, and examples of inhibiting materials that can be used, are described in particular in French patent application FR 2 275 425 and U.S. Pat. No. 5,682,013.

For an ordinary type of charge having its surface completely free, gas is delivered at a very high rate after ignition, thereby enabling pressure to rise rapidly in the combustion chamber and in the delay chamber, leading to rapid rupture of the seal at the outlet from the delay chamber. However, as the charge burns, its combustion surface area decreases, so the rate at which gas is generated decreases. In certain circumstances, the quantity of gas that is generated after the outlet orifice from the delay chamber has opened is not sufficient, e.g. to be effective in moving a piston situated at the outlet from the gas generator or for maintaining sufficient pressure upstream from such a piston in order to damp it.

The use of a main pyrotechnic charge having a portion of its surface covered in a combustion-inhibiting coating makes it possible to adapt the combustion surface area and thus the gas flow rate in such a manner as to optimize ignition, the conditions (in particular duration) for pressurizing the combustion and delay chambers, and the conditions for delivering combustion gas out from the gas generator.

Among pyrotechnic charges that are suitable on combustion for generating a long combustion time and a quasi-constant gas flow rate, it is possible by way of non-limiting example to mention a pyrotechnic charge that is substantially cylindrical in shape, in particular in the form of a right cylinder, e.g. of the solid monolithic block type or of the stack of disks type, defined by first and second end faces and by a side surface extending between said end faces, the first end face being covered in a combustion-inhibiting protective coating, the second end face being free, and the side surface being covered in a combustion-inhibiting coating over a portion of its length from said first end face and being free over the remainder of its length.

Under such circumstances, the pyrotechnic charge presents a first segment with a free surface (i.e. a non-inhibited surface) of dimensions that are sufficient to ensure ignition and rapid and reproducible setting into combustion of the charge, followed by an inhibited second segment that ensures that the combustion front advances axially and thus operates for a long time, preferably at a quasi-constant flow rate.

In another embodiment, the first end face of the charge and its entire side surface are covered in a combustion-inhibiting coating, while the second end face is free. The side surface of the charge is thus combustion-inhibited over its entire length (i.e. from its first axial end face to its second axial end face).

The person skilled in the art also knows how to apply the above-specified principles to a main pyrotechnic charge in the form of a cylindrical block having a cylindrical central channel that is straight or star-shaped, with combustion being inhibited over a fraction of its surface area in order to satisfy ignition specifications. Under such circumstances, the combustion-inhibiting coating is generally distributed in compliance with the above examples, while leaving the inside surface of the block free.

The invention also provides an assembly comprising an actuator having an actuator cylinder housing a movable assembly comprising a piston and a rod projecting from one end of said cylinder, and a pyrotechnic gas generator as described above, wherein the delay chamber of the gas generator is arranged relative to the piston of the actuator in such a manner that the pressure of the gas escaping via the exhaust orifice applies a force against the piston.

In an embodiment, the actuator and the gas generator are connected together so that the outlet orifice(s) of the delay chamber is/are positioned facing the piston.

In an embodiment, an actuation chamber is defined between the delay chamber and the piston, the delay chamber communicating with said actuation chamber via the outlet orifice.

For example, the actuation chamber is defined firstly by the delay chamber and the piston, and secondly by the body of the generator and/or by the cylinder of the actuator.

BRIEF DESCRIPTION OF THE DRAWINGS

The invention can be better understood and other advantages of the invention appear more clearly in the light of the following description of an assembly constituted by a pyrotechnic gas generator and an actuator of the invention, given purely by way of example and described with reference to the accompanying drawings, in which.

DETAILED DESCRIPTION

Figure 1:
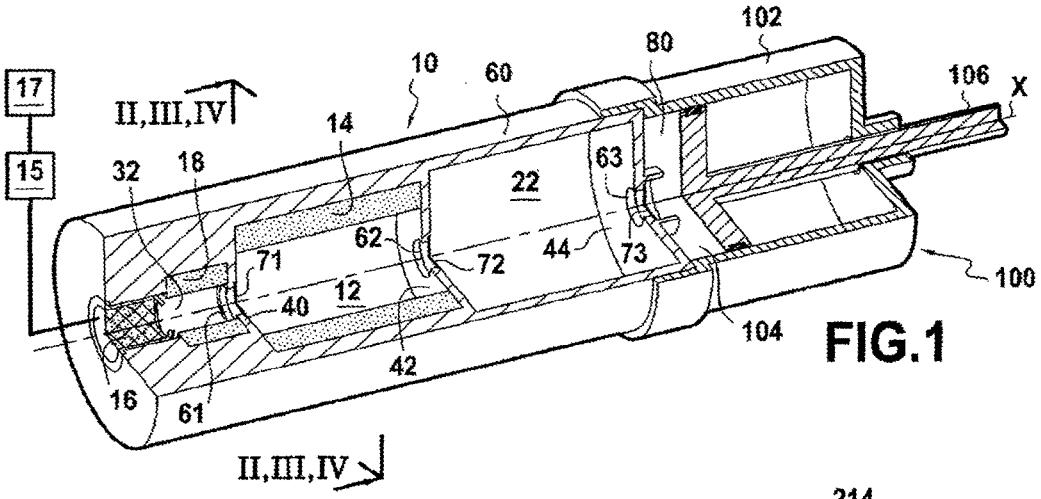
FIG. 1 is a partially cutaway perspective view of an assembly of the invention comprising a pyrotechnic gas generator and an actuator that can be driven by said gas generator.

FIG. 1 shows an assembly comprising an actuator 100 and a gas generator 10 of the invention co-operating with said actuator 100 in order to drive it under the effect of a trigger command.

The actuator 100 comprises a hollow cylinder 102 of axis X containing a moving assembly formed by a piston 104 mounted to slide along the inside radial wall of the cylinder 102, and by a rod 106 secured to the piston 104 and projecting from the downstream end of the cylinder 102.

Although not shown, the downstream end of the rod 106 is connected directly or indirectly to a structure that is to be actuated, e.g. a door, and in particular an airplane door.

The gas generator 10 comprises a generator body 60 of generally cylindrical shape (of axis X) having its downstream end connected by an appropriate means to the upstream end of the actuator cylinder 102.

The generator body 60 houses a combustion chamber 12 receiving a main pyrotechnic charge 14, an ignition chamber 32 that communicates with the combustion chamber 12 and that contains an ignitor for initiating combustion of the main pyrotechnic charge 14, and a delay chamber 22 communicating with the combustion chamber 12.

In this example, the ignition chamber 32, the combustion chamber 12, and the delay chamber 22 are arranged in that order from upstream to downstream along the axis X.

In a radial direction, each of the chambers 32, 12, and 22 is defined by the body 60, and in an axial direction each of them is defined by respective upstream and downstream walls extending transversely to the longitudinal direction X of the body 60.

An inlet orifice 61 of the combustion chamber 12, formed in this example in its upstream wall 40, provides communication between said chamber 12 and the ignition chamber 32.

As can be seen in FIG. 1, the delay chamber 22 communicates with the combustion chamber 12 via an inlet orifice 62 that is formed in this example in the upstream wall 42 of the delay chamber 22. The delay chamber 22 is also provided with an outlet orifice 63 formed in its downstream wall 44 and constituting an outlet orifice to the outside of the gas generator 10.

In this example, the inlet orifice 61 of the combustion chamber 12 and the upstream and downstream orifices 62 and 63 of the delay chamber 22 are all closed by detachable or breakable seals given respective references 71, 72, 73. Each seal 71, 72, 73 is adapted to go from a closed state in which the respective orifice 61, 62, 63 with which it co-operates is closed, to an open state in which the orifice is open, on a rupture limit pressure being applied thereto. It should be observed that the seal 73 for shutting the outlet orifice of the delay chamber is preferably not fragmentable in order to avoid fragments penetrating into the actuator cylinder, in particular metal fragments if the seal is made of metal.

In this example, the ignitor comprises a pyrotechnic initiator 16, trigger means 15 for the pyrotechnic initiator 16, and an ignition relay 18 formed by an intermediate pyrotechnic charge.

The pyrotechnic initiator 16 is of conventional type and, by way of example, it comprises a heating resistor element (not shown) placed in contact with a pyrotechnic material forming a so-called "initiator" charge.

By way of example, the trigger means 15 may be constituted by an electrical connection connected to a control unit 17 and also to the heating resistor element (not shown) of the initiator.

Such an electro-pyrotechnic initiator 16 is suitable for initiating combustion of the ignition relay 18, which combustion generates gas suitable for initiating combustion of the main pyrotechnic charge 14, as described in greater detail below.

Figure 2:
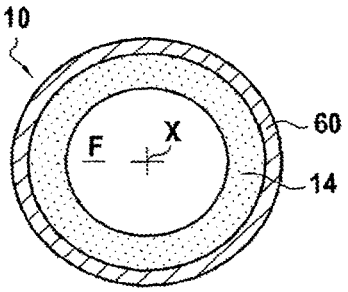
FIG. 2 is a section of the gas generator on plane II-II of FIG. 2.

In the example of FIGS. 1 and 2, the main pyrotechnic charge 14 is in the form of a hollow cylindrical block of pyrotechnic material located beside the peripheral wall of the combustion chamber 12. The empty space in the combustion chamber 12 is referenced F in FIG. 2.

Figure 3:
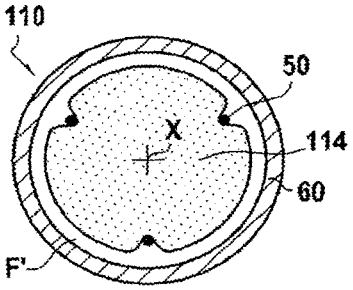
FIG. 3 is a section of the gas generator on plane II-II of FIG. 2, showing a variant for positioning the main pyrotechnic charge inside the combustion chamber.

In a variant embodiment shown in FIG. 3, the main pyrotechnic charge 114 could equally well be in the form of a solid or hollow cylindrical block. Under such circumstances, in order to conserve empty space F' for allowing gas to expand and pass through the combustion chamber 12, the charge 114 is held spaced apart from the peripheral wall of the chamber 12, preferably around its entire circumference, by spacer means 50. More particularly, in the example shown, the block of the main pyrotechnic charge is a solid block with lobes, in particular three lobes, and the spacer means are centering rods, e.g. fastened to the upstream and downstream walls of the chamber 12 and co-operating with axial slots formed in the periphery of the charge 114, at the junctions between the lobes of the block.

Figure 4:
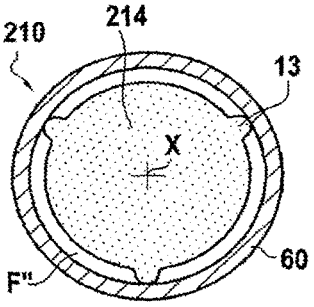
FIG. 4 is a section of the gas generator on plane IV-IV of FIG. 2, showing yet another variant configuration for the main pyrotechnic charge inside the combustion chamber.

In another variant embodiment shown in FIG. 4, the pyrotechnic charge 214 is a solid block provided with longitudinal splines 13, that are preferably regularly distributed around its periphery. Each spline 13 presses against the peripheral wall of the combustion chamber 12. Between the splines, the periphery of the block is thus spaced apart from the wall of the combustion chamber, thereby forming a space F" allowing gas to pass to the outlet orifice of the chamber. The splines 13 are easily obtained during the operation of molding the block, and they make it possible to limit the number of parts in the gas generator.

In certain situations that require gas to be generated over a long period and at a rate that is substantially constant, it is possible to envisage coating a portion of the surface of the main pyrotechnic charge with a combustion-inhibiting protective coating, thereby making it possible to enhance a particular propagation direction for the combustion front over time. It is then said that the pyrotechnic charge is combustion-inhibited over a portion of its surface.

Figure 6:
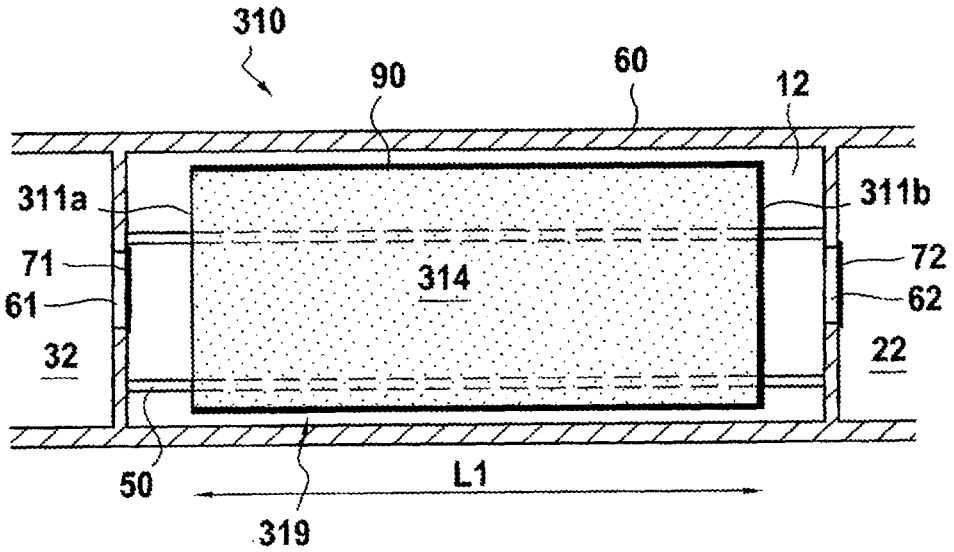
FIG. 6 is an axial section view showing a particular example of a pyrotechnic charge suitable for use in a gas generator of the invention.

FIG. 6 is a diagrammatic illustration of a main pyrotechnic charge 314 of the type described with reference to FIG. 3 located inside the combustion chamber and covered over a fraction of its surface in a combustion-inhibiting varnish 90.

In this example, the side surface 319 of the pyrotechnic charge 314 is covered in an anti-combustion protective coating over its entire length L1, i.e. from one of its end faces to the other end face, and over its entire circumference. One of the end faces 311*a*, 311*b* (in this example the end face 311*a* facing towards the ignitor) is free (i.e. not combustion-inhibited), while its opposite end face 311*b* is covered in the combustion-inhibiting coating.

With such an arrangement, the combustion front propagates axially in the charge 314, and the combustion surface area, corresponding substantially to the radial section of the charge, remains relatively constant throughout combustion. The flow of gas generated in the combustion chamber 12 is moderated by the small combustion surface area, but it does remain substantially constant.

Figure 7:
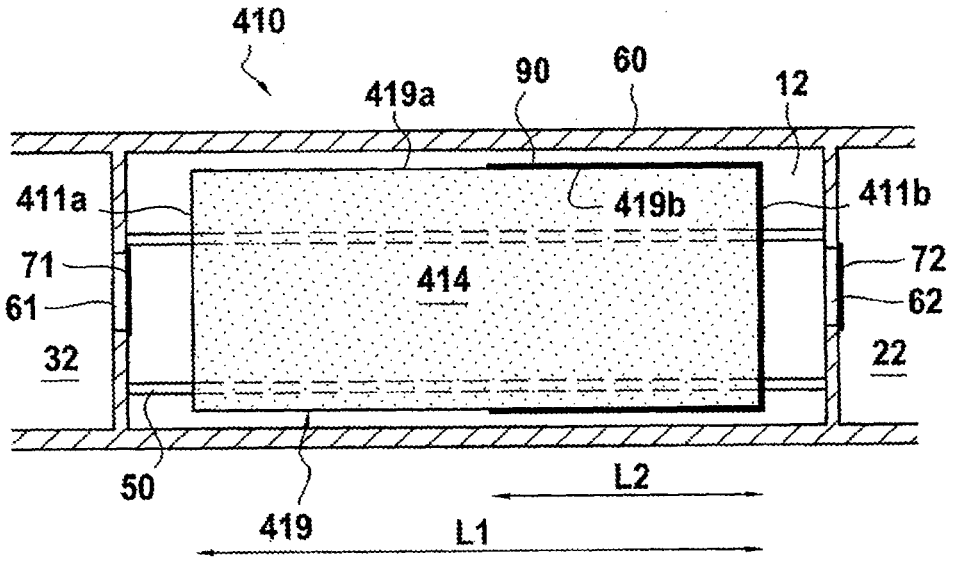
FIG. 7 is an axial section view showing another example of a pyrotechnic charge that can be used.

FIG. 7 shows a variant of the FIG. 6 embodiment in which one end face 411*b* of the pyrotechnic charge 414 is inhibited together with its side surface 419*b* over a first axial segment of said charge 414 extending from said inhibited end face 411*b* over a limited length L2 of the charge. The side surface 419*a* is not combustion-inhibited over a second segment of the charge extending from its other end face 411*a*, which is not inhibited. The initial combustion surface area of the charge, corresponding to the entire non-inhibited surface of the cylinder (one of its end faces plus a fraction of its side face starting from said end face) then decreases so as to become limited to the frontal surface area of the inhibited portion of the cylinder.

In a variant that is not shown, the pyrotechnic charge could also be in the form of a cylindrical block having a central channel of circular or star-shaped section, in particular a block having a star-shaped channel with at least five branches, which block is combustion-inhibited over all or part of the length of its outside face, while the wall of said channel remains free, and the other characteristics as described above with reference to FIGS. 6 and 7 remain applicable.

In the embodiments of FIGS. 3, 4, 6, and 7, care is taken to space the pyrotechnic charge axially from the axial end walls of the combustion chamber.

More generally, care is taken at least to leave free the orifices of the combustion chamber that are formed in these walls and that serves to pass gas.

With reference to FIGS. 1 to 5, there follows an explanation of the operating principle of the above-described pyrotechnic gas generator 10 when used for driving an actuator 100 of the above-specified type.

At an instant T=T0, an operator initiates a trigger command, whereby electricity is transmitted to the resistor element of the pyrotechnic initiator 16. On passing current, the resistor element heats by the Joule effect, thereby initiating combustion of the initiator charge.

The combustion of the initiator charge quickly initiates combustion of the intermediate charge of the ignition relay 18.

Figure 5:
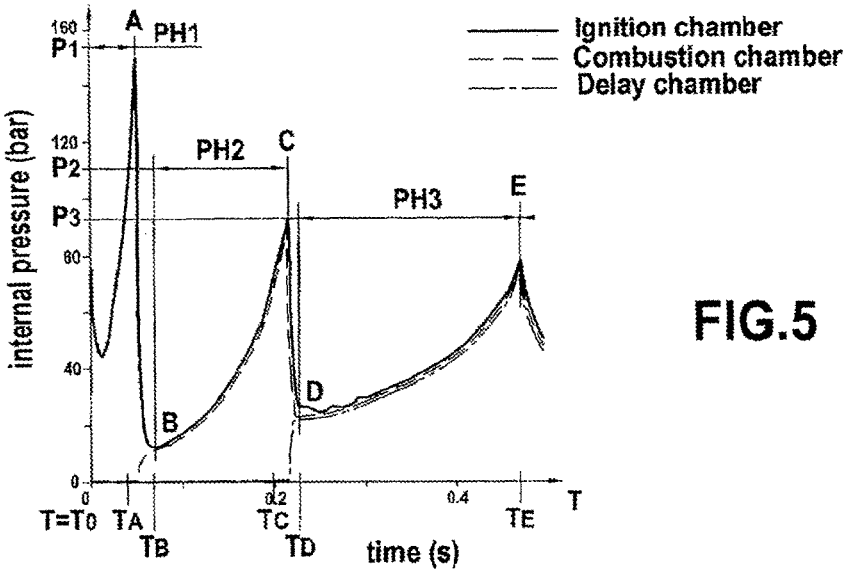
FIG. 5 is a graph showing the sequence with which the various sections of the FIG. 1 assembly are pressurized after the gas generator has been triggered.

As it burns, the ignition relay 18 causes gas to be released into the ignition chamber 32 such that the pressure inside said chamber increases rapidly (stage PH1 in FIG. 5).

The free volume in the ignition chamber 32 (i.e. the volume that can be occupied by gas) is very small. The rise in pressure inside this chamber 32 (stage PH1 in FIG. 5) and thus the transmission of the priming signal from the pyrotechnic initiator 16 to the main pyrotechnic charge 14 is thus fast and reliable.

At an instant T=TA, the pressure inside the ignition chamber 32 reaches the rupture limit pressure P1 of the shutter 71, so that it goes from its closed state to its open state, thereby allowing gas to pass from the ignition chamber 32 into the combustion chamber 12.

At this instant TA, the pressure in the ignition chamber 32 drops rapidly, and simultaneously the pressure in the combustion chamber 12 increases until pressures are balanced in the two chambers (instant TB on the curve in FIG. 5).

At the same time, the gas from the intermediate charge 18 initiates combustion of the main pyrotechnic charge 14, which in turn releases a large quantity of gas into the combustion chamber 12.

As combustion continues, the pressure inside the combustion chamber 12 and the ignition chamber 32 increases (stage PH2 in FIG. 5).

Since the combustion chamber 12 presents a free volume that is small, e.g. lying in the range 1 $cm^3$ to 20 $cm^3$, its pressure rises quickly and the combustion of the main pyrotechnic charge 14 is stable.

When the pressure reaches the rupture limit pressure P2 of the shutter 72, it passes into its open state, thereby allowing gas to pass from the combustion chamber 12 into the delay chamber 22. At this instant T=TC, the pressure drops very quickly in the combustion chamber 12 and in the ignition chamber 32, while simultaneously increasing very quickly in the delay chamber 22.

At an instant T=TD, the pressures in the three chambers 12, 22, and 32 are substantially in equilibrium. The main pyrotechnic charge 14 nevertheless continues to give off gas, so the pressure inside the gas generator 10 continues to increase progressively.

According to a preferred provision, the free volume in the delay chamber 22 is more than four times, and preferably more than 20 times the volume of the combustion chamber 12. The length of time required to pressurize the delay chamber 22 is thus longer than that required for the combustion chamber 12 (stage PH3 longer than PH2 in FIG. 5).

At an instant TE, the pressure inside the gas generator reaches the rupture limit pressure P3 of the shutter 73, so that it passes into its open state, thereby allowing gas to pass from the delay chamber 22. At this instant T=TE, gas is transmitted to the piston 104 in order to drive the actuator 100.

In this example, the outlet orifice 63 from the delay chamber 22 is situated directly facing the upstream face of the piston 104.

As can be seen in FIG. 1, the piston 602 and the downstream wall 44 of the delay chamber 22 co-operate with the actuator cylinder 102 to define an actuation chamber 80 of the actuator that receives the gas coming from said chamber 22 once the seal 73 is in the open state. The gas contained in the actuation chamber 80 exerts a force on the piston that is proportional to the pressure in the chamber 80. For a predetermined pressure, the piston is finally moved downstream, thereby driving the actuator 100.

It can be understood that the stage PH3 of the pressure rising in the delay chamber 22, starting from the opening of the inlet orifice 62 and continuing until sufficient pressure is obtained to open the outlet orifice 63 of the chamber, serves to delay the exit of gas from the generator 10, and thus to delay driving the actuator 100, as compared with known pyrotechnic gas generators of the prior art.

It should be observed that the gas generator of the invention that was used for acquiring the curve shown in FIG. 5 presented the following non-limiting characteristics: free volume of the ignition chamber, 2 $cm^3$; free volume of the combustion chamber, 12 $cm^3$; free volume of the delay chamber, 48 $cm^3$; pyrotechnic charge mass equal to 33 g; rupture limit pressure for the seal 71 closing the inlet orifice 61 of the combustion chamber 12, 150 bars; rupture limit pressure of the seal 72 closing the inlet orifice 62 of the delay chamber 22, 90 bars; and rupture limit pressure of the seal 73 closing the outlet orifice 63 of the delay chamber 22, 80 bars.

The invention claimed is:

1. A pyrotechnic gas generator for driving an actuator, the pyrotechnic gas generator comprising:

a body defining a combustion chamber housing a main pyrotechnic charge;

an ignitor for initiating combustion of said main pyrotechnic charge; and at least one delay chamber housing no pyrotechnic charge that is defined by walls that are stationary relative to one another and that is adapted to communicate with said combustion chamber via at least one inlet orifice, wherein said at least one delay chamber is provided with at least one outlet orifice for passing gas out from said pyrotechnic gas generator, said at least one outlet orifice being provided with a seal adapted to pass from a closed state to an open state when a pressure inside the at least one delay chamber reaches a rupture limit pressure, and wherein the main pyrotechnic charge is spaced apart from a wall of the combustion chamber by centering rods co-operating with axial slots formed in a periphery of the main pyrotechnic charge.

2. The pyrotechnic gas generator according to claim 1, wherein the body is elongate in a main direction, the combustion chamber and the at least one delay chamber being arranged one after another inside said body in said main direction.

3. The pyrotechnic gas generator according to claim 2, wherein the at least one delay chamber is defined in the main direction by an upstream wall and by a downstream wall, the at least one inlet orifice being arranged in said upstream wall and the at least one outlet orifice being arranged in said downstream wall.

4. The pyrotechnic gas generator according to claim 1, wherein the body is cylindrical.

5. The pyrotechnic gas generator according to claim 1, wherein the main pyrotechnic charge is arranged inside the combustion chamber in such a manner as to define a gas-passing passage radially between the wall of the combustion chamber and said main pyrotechnic charge.

6. The pyrotechnic gas generator according to claim 1, wherein the main pyrotechnic charge presents a shape that is substantially cylindrical, being defined by first and second end faces and a side surface extending between said end faces, the first end face being covered in a combustion-inhibiting protective coating, the second end face being free of the combustion-inhibiting protective coating, and the side surface being covered in a combustion-inhibiting coating over a portion of its length from said first end face and being free of the combustion-inhibiting protective coating over a remainder of its length.

7. The pyrotechnic gas generator according to claim 1, wherein the main pyrotechnic charge is of a shape that is substantially cylindrical, being defined by first and second end faces and a side surface extending between said end faces, the first end face and its entire side surface being covered in a combustion-inhibiting protective coating, while the second end face is free of the combustion-inhibiting protective coating.

8. The pyrotechnic gas generator according to claim 1, wherein a free volume of the at least one delay chamber is greater than four times a free volume of the combustion chamber.

9. The pyrotechnic gas generator according to claim 1, wherein the at least one inlet orifice of the at least one delay chamber is provided with a seal suitable for passing from a closed state to an open state when a gas pressure inside the combustion chamber reaches a second rupture limit pressure.

10. The pyrotechnic gas generator according to claim 1, wherein the ignitor comprises a pyrotechnic initiator.

11. The pyrotechnic gas generator according to claim 10, wherein the ignitor comprises a mechanical trigger to trigger the pyrotechnic initiator.

12. The pyrotechnic gas generator according to claim 10, wherein the ignitor comprises an electrical trigger to trigger the pyrotechnic initiator.

13. The pyrotechnic gas generator according to claim 10, wherein the ignitor further comprises an ignition relay.

14. The pyrotechnic gas generator according to claim 13, further comprising an ignition chamber adapted to communicate with the combustion chamber via at least one inlet orifice of the combustion chamber, the pyrotechnic initiator and the ignition relay being housed in said ignition chamber.

15. An assembly comprising:

an actuator having an actuator cylinder housing a movable assembly comprising a piston and a rod projecting from one end of said actuator cylinder, and a pyrotechnic gas generator according to claim 1, wherein the at least one delay chamber of the pyrotechnic gas generator is arranged relative to the piston of the actuator in such a manner that a pressure of the gas escaping via the at least one outlet orifice applies a force against the piston.

16. An assembly according to claim 15, wherein an actuation chamber is defined between the at least one delay chamber and the piston, the at least one delay chamber communicating with said actuation chamber via the at least one outlet orifice.

17. The pyrotechnic gas generator according to claim 1, wherein a free volume of the at least one delay chamber is greater than 20 times a free volume of the combustion chamber.

18. The pyrotechnic gas generator according to claim 1, wherein a portion of a surface of the main pyrotechnic charge is covered in a combustion-inhibiting protective coating.

19. The pyrotechnic gas generator according to claim 1, wherein the main pyrotechnic charge is spaced apart from the wall of the combustion chamber by three of the centering rods co-operating with three of the axial slots formed in an outer face of the main pyrotechnic charge.

* * * * *